US011319862B2

(12) United States Patent
Saruwatari

(10) Patent No.: US 11,319,862 B2
(45) **Date of Patent: *May 3, 2022**

(54) OUTBOARD MOTOR AND MARINE VESSEL

(71) Applicant: YAMAHA HATSUDOKI KABUSHIKI KAISHA, Iwata (JP)

(72) Inventor: Kimitaka Saruwatari, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 77 days.

This patent is subject to a terminal disclaimer.

(21) Appl. No.: 16/866,589

(22) Filed: May 5, 2020

(65) Prior Publication Data

US 2020/0370462 A1 Nov. 26, 2020

(30) Foreign Application Priority Data

May 21, 2019 (JP) ..... JP2019-095400

(51) Int. Cl.
*F01P 3/20* (2006.01)
*B63H 20/28* (2006.01)
*F01P 3/12* (2006.01)

(52) U.S. Cl.
CPC ..... *F01P 3/202* (2013.01); *B63H 20/28* (2013.01); *F01P 3/12* (2013.01); *F01P 2050/12* (2013.01)

(58) Field of Classification Search
CPC .. F01P 3/00; F01P 2003/001; F01P 2003/008; F01P 3/12; F01P 3/20; F01P 2050/12; F01P 20/00; F01P 20/001; F01P 20/28; B63H 20/28; B63H 20/00; B63H 20/001
USPC ..... 440/88 R, 88 C, 88 M, 88 F, 88 D, 440/88 HE, 88 P
See application file for complete search history.

(56) References Cited

U.S. PATENT DOCUMENTS

| | | | | |
|---|---|---|---|---|
| 4,728,306 | A | 3/1988 | Schneider | |
| 6,343,966 | B1 | 2/2002 | Martin et al. | |
| 8,333,629 | B2 | 12/2012 | McChesney et al. | |
| 10,890,097 | B1 * | 1/2021 | Kurzynski | B63H 20/28 |
| 11,072,408 | B1 * | 7/2021 | Kurzynski | B63H 20/28 |
| 11,073,116 | B1 * | 7/2021 | Dins | B63H 21/383 |
| 2017/0328265 | A1 * | 11/2017 | George | F01P 5/12 |

FOREIGN PATENT DOCUMENTS

| | | |
|---|---|---|
| EP | 3 309 369 A1 | 4/2018 |
| JP | 2015-067191 A | 4/2015 |

OTHER PUBLICATIONS

Official Communication issued in corresponding European Patent Application No. 20171958.0, dated Oct. 27, 2020.

* cited by examiner

*Primary Examiner* — Daniel V Venne
(74) *Attorney, Agent, or Firm* — Keating and Bennett, LLP

(57) ABSTRACT

An outboard motor includes a first cooling water passage through which first cooling water including water from outside an outboard motor body passes to cool a first cooling target including at least one of an electrical component other than an engine and fuel in a fuel tank, and a first pump that is an electric pump that pumps the first cooling water from outside of the outboard motor body and flows the first cooling water into the first cooling water passage.

19 Claims, 5 Drawing Sheets

OUTBOARD MOTOR AND MARINE VESSEL

CROSS REFERENCE TO RELATED APPLICATIONS

This application claims the benefit of priority to Japanese Patent Application No. 2019-095400 filed on May 21, 2019. The entire contents of this application are hereby incorporated herein by reference.

BACKGROUND OF THE INVENTION

1. Field of the Invention

The present invention relates to an outboard motor and a marine vessel.

2. Description of the Related Art

An outboard motor including pumps that pump water from the outside of an outboard motor body is known in general. Such an outboard motor is disclosed in Japanese Patent Laid-Open No. 2015-067191, for example.

Japanese Patent Laid-Open No. 2015-067191 discloses a cooler for an outboard motor including a main pump that supplies cooling water to an engine unit. The main pump is disposed in an upper portion of the outboard motor and is a non-positive displacement electric pump. In addition, the cooler includes an engine-driven secondary pump disposed in a lower portion of the outboard motor and driven by the driving force of an engine of the engine unit. The secondary pump is a positive-displacement pump, and pumps water from the outside of the outboard motor via a water inlet. The secondary pump supplies the pumped water to the main pump. That is, the secondary pump is a pump that primes the main pump. The main pump is driven to pump the cooling water into a cooling water passage of the engine unit.

However, in a conventional outboard motor as disclosed in Japanese Patent Laid-Open No. 2015-067191, there is no water cooling structure that operates while the engine is stopped, and thus when the engine is stopped, electrical components and fuel in a fuel tank cannot be cooled by the cooling water. Therefore, when the electrical components operate while the engine is stopped, the electrical components conceivably generate heat. Even when the electrical components do not operate, it is conceivably necessary to use high heat resistant materials for the electrical components. Immediately after the engine is stopped (at the time of dead soak), the temperature of engine oil is relatively high, and thus the temperature inside the engine in which the engine oil is located is conceivably relatively high. In addition, the temperature of the fuel in the fuel tank provided in the vicinity of the engine is conceivably relatively high due to the relatively high temperature of the engine. Thus, the size of a fuel vaporized gas treatment system is conceivably increased in order to cope with an increase in the temperature of the fuel. In such a case, the layout in the outboard motor is conceivably further restricted.

SUMMARY OF THE INVENTION

Preferred embodiments of the present invention provide outboard motors and marine vessels that cool cooling targets including at least one of fuel in fuel tanks and electrical components with cooling water even when the engines are stopped.

An outboard motor according to a preferred embodiment of the present invention includes a first cooling water passage through which first cooling water including water from outside an outboard motor body passes to cool a first cooling target including at least one of an electrical component other than an engine and fuel in a fuel tank, and a first pump that is an electric pump to pump the first cooling water from the outside of the outboard motor body into the first cooling water passage.

In an outboard motor according to a preferred embodiment of the present invention, the first pump is an electric pump that pumps the first cooling water from the outside of the outboard motor body and into the first cooling water passage. Accordingly, even while the engine is stopped, the first pump defines and functions as an electric pump driven by electric power to pump the first cooling water from the outside. Therefore, even while the engine is stopped, the first pump is driven such that the first cooling target including at least one of the electrical component and the fuel in the fuel tank is cooled with the first cooling water.

In an outboard motor according to a preferred embodiment of the present invention, the engine preferably rotates a drive shaft connected to a propeller, the outboard motor preferably further includes a rotary electric machine that drives the outboard motor by rotating the drive shaft, the first cooling target preferably includes the electrical component, and the electrical component preferably includes a component of a power supply system that supplies electric power to the rotary electric machine. It is conceivable that the outboard motor is driven by both the engine and the rotary electric machine (the hybrid technology of the engine and the rotary electric machine is used). In such a case, the component of the power supply system that supplies electric power to the rotary electric machine conceivably generates heat when the rotary electric machine is driven while the engine is stopped. In this regard, according to a preferred embodiment of the present invention, the first cooling target includes the electrical component, and the electrical component includes the component of the power supply system that supplies electric power to the rotary electric machine such that the first pump is driven even while the engine is stopped. Thus, the component of the power supply system as the first cooling target is cooled with the first cooling water. Consequently, even when the hybrid technology of the engine and the rotary electric machine that drives the outboard motor is applied to the outboard motor, the electrical component, for example, is effectively cooled.

An outboard motor according to a preferred embodiment of the present invention preferably further includes a second cooling water passage through which second cooling water passes to cool a second cooling target that is different from the first cooling target and includes the engine, and a second pump to pump the second cooling water into the second cooling water passage. Accordingly, the outboard motor includes the first pump and the second pump, and thus unlike a case in which all of the cooling targets are cooled by one pump, the cooling target (first cooling target) cooled by the first pump and the cooling target (second cooling target) cooled by the second pump are separated. Therefore, an increase in the size of each of the first pump and the second pump is significantly reduced or prevented. Consequently, the first pump and the second pump, in which increases in their sizes are significantly reduced or prevented, are separated and easily disposed in a limited space inside the outboard motor.

In such a case, the first pump preferably has a cooling water pumping capacity per unit time smaller than a cooling water pumping capacity per unit time of the second pump. Accordingly, an increase in the size of the first pump is further significantly reduced or prevented.

In an outboard motor including the second pump, both the first pump and the second pump are preferably positive-displacement pumps. When one of the first pump and the second pump is a non-positive displacement pump, it is necessary to prime the non-positive displacement pump from the outside of the outboard motor body. In this regard, according to a preferred embodiment of the present invention, both the first pump and the second pump are positive-displacement pumps, and thus both the first pump and the second pump easily pump water from outside the outboard motor body without priming the first pump and the second pump.

In an outboard motor including the second pump, the first cooling water passage and the second cooling water passage preferably include a common water inlet through which the first cooling water and the second cooling water are taken in upstream of the first cooling target and upstream of the second cooling target. Accordingly, the water inlet through which the first cooling water is taken in and the water inlet through which the second cooling water is taken in are shared, and thus a complex structure of the outboard motor is significantly reduced or prevented.

In an outboard motor including the second pump, the second pump is preferably an engine-driven pump driven by the drive shaft when the engine drives the drive shaft. The amount of heat generated by the engine included in the second cooling target increases as the rotation speed increases. Therefore, the second pump is an engine-driven pump, as described above, such that the flow rate of the second cooling water that flows through the second cooling water passage is increased according to an increase in the amount of heat generated by the engine.

In an outboard motor including the second pump, the engine preferably rotates a drive shaft connected to a propeller, and the first cooling target preferably includes a rotary electric machine that drives the outboard motor by rotating the drive shaft. Accordingly, even while an engine is stopped, the rotary electric machine that generates heat when driven is cooled with the first cooling water (first pump).

An outboard motor including the rotary electric machine preferably further includes a rotation speed detector that detects a rotation speed of the rotary electric machine, and driving of the first pump is preferably controlled based on the rotation speed of the rotary electric machine detected by the rotation speed detector. Accordingly, the rotation speed of the rotary electric machine is detected such that the first pump is driven as necessary. For example, when the rotary electric machine is being driven and the electrical component is generating heat, the first pump is effectively driven such that the electrical component is effectively cooled. Furthermore, when the rotary electric machine is included in the first cooling target, the rotary electric machine is effectively cooled.

In an outboard motor according to a preferred embodiment of the present invention, the first pump is preferably drivable while the engine is stopped. Accordingly, the first pump is driven while the engine is stopped, and thus the first cooling target is cooled even while the engine is stopped.

In an outboard motor according to a preferred embodiment of the present invention, the first cooling target preferably includes the electrical component, the electrical component preferably includes a component of a power supply system including an inverter and a converter, and the first cooling water passage preferably includes a portion that cools the inverter upstream of a portion that cools the converter. Accordingly, the inverter that generates more heat than the converter is cooled in a relatively upstream portion of the first cooling water passage. Consequently, the first cooling water on the upstream side on which the temperature is lower than that on the downstream side effectively cools the inverter that generates a large amount of heat.

An outboard motor according to a preferred embodiment of the present invention preferably further includes a temperature detector that detects a temperature of the first cooling target, and driving of the first pump is preferably controlled based on the temperature detected by the temperature detector. When the temperature of the first cooling target becomes abnormal in spite of driving the first pump, the first pump may not be operating normally (abnormalities may have occurred). In consideration of this, driving of the first pump is controlled based on the temperature detected by the temperature detector. Accordingly, for example, when the temperature of the first cooling target is abnormal, driving of the first pump is limited. Consequently, driving of the first pump in an abnormal state is significantly reduced or prevented.

An outboard motor according to a preferred embodiment of the present invention preferably further includes a water pressure detector that detects a water pressure of the first cooling water that flows through the first cooling water passage, and driving of the first pump is preferably stopped when the water pressure detected by the water pressure detector is equal to or lower than a water pressure threshold. When the water pressure of the first cooling water becomes equal to or lower than the water pressure threshold in spite of driving the first pump, the first pump may not be operating normally (abnormalities may have occurred). In consideration of this, driving of the first pump is stopped when the water pressure detected by the water pressure detector is equal to or lower than the water pressure threshold. Accordingly, when there is a possibility that the first pump is not operating normally, driving of the first pump is stopped. Consequently, driving of the first pump in an abnormal state is significantly reduced or prevented.

In an outboard motor according to a preferred embodiment of the present invention, the first cooling target preferably further includes the fuel in the fuel tank, and the first cooling water passage is preferably disposed along the fuel tank such that the first cooling water in the first cooling water passage cools the fuel in the fuel tank. Accordingly, the temperature becomes high immediately after an engine is stopped, and thus the fuel in the fuel tank, which is preferably cooled even while the engine is stopped, is cooled with the first cooling water. Consequently, even while the engine is stopped, the fuel in the fuel tank is cooled such that volatilization of the fuel is significantly reduced or prevented.

In an outboard motor according to a preferred embodiment of the present invention, the first cooling target preferably includes a rectifier/regulator as the electrical component, and the first cooling water passage is preferably disposed along the rectifier/regulator such that the first cooling water in the first cooling water passage cools the rectifier/regulator. Accordingly, the rectifier/regulator is cooled even while the engine is stopped. Consequently, even when the temperature of the rectifier/regulator is relatively high after the engine is stopped, the rectifier/regulator is effectively cooled with the first cooling water.

A marine vessel according to a preferred embodiment of the present invention includes a hull and an outboard motor attached to the hull and including an engine. The outboard motor includes a first cooling water passage through which first cooling water including water from outside an outboard motor body passes to cool a first cooling target including at least one of an electrical component other than the engine and fuel in a fuel tank, and a first pump that is an electric pump to pump the first cooling water from outside of the outboard motor body into the first cooling water passage.

In a marine vessel according to a preferred embodiment of the present invention, similarly to the outboard motor according to preferred embodiments of the present invention described above, at least one of the electrical component and the fuel in the fuel tank is cooled with the first cooling water even while the engine is stopped.

In a marine vessel according to a preferred embodiment of the present invention, the engine preferably rotates a drive shaft connected to a propeller, the marine vessel preferably further includes a rotary electric machine that drives the outboard motor by rotating the drive shaft, the first cooling target preferably includes the electrical component, and the electrical component preferably includes a component of a power supply system that supplies electric power to the rotary electric machine. Accordingly, even while the engine is stopped, the first pump is driven such that the component of the power supply system as the first cooling target is cooled with the first cooling water. Consequently, even when the hybrid technology of the engine and the rotary electric machine that drives the outboard motor is applied to the outboard motor, the electrical component, for example, is effectively cooled.

A marine vessel according to a preferred embodiment of the present invention preferably further includes a second cooling water passage through which second cooling water passes to cool a second cooling target that is different from the first cooling target and includes the engine, and a second pump to pump the second cooling water into the second cooling water passage. Accordingly, it is not necessary to provide a function of cooling the second cooling target in the first pump as an electric pump, and thus an increase in the size of the first pump and an increase in the size of the electrical component are significantly reduced or prevented. Furthermore, an increase in the amount of heat generated by the first pump and an increase in the amount of heat generated by the electrical component are significantly reduced or prevented.

In such a case, the first pump preferably has a cooling water pumping capacity per unit time smaller than a cooling water pumping capacity per unit time of the second pump. Accordingly, an increase in the size of the first pump is further significantly reduced or prevented.

In a marine vessel including the second pump, both the first pump and the second pump are preferably positive-displacement pumps. Accordingly, both the first pump and the second pump easily pump water from outside the outboard motor body without priming the first pump and the second pump.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

Figure 1:
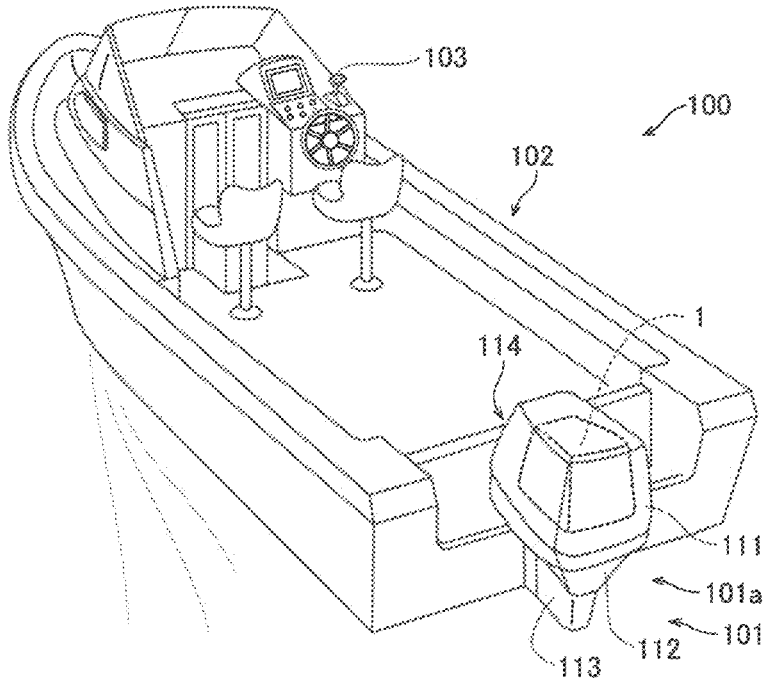
FIG. 1 is a perspective view showing the structure of a marine vessel including an outboard motor according to a first preferred embodiment of the present invention.

The structure of a marine vessel 100 according to a first preferred embodiment of the present invention is now described with reference to FIGS. 1 to 6. As shown in FIG. 1, the marine vessel 100 includes an outboard motor 101, a hull 102, and a remote control 103.

As shown in FIG. 1, the outboard motor 101 is attached to a rear portion of the hull 102. The outboard motor 101 includes an outboard motor body 101*a*. The outboard motor body 101*a* is a case that houses each portion of the outboard motor 101. Specifically, the outboard motor body 101*a* includes a cowl 111 that houses an engine 1, an upper case 112 provided below the engine 1, a lower case 113 provided below the upper case 112, and a bracket 114 disposed in front of the upper case 112. The outboard motor 101 is attached to the hull 102 by the bracket 114 so as to be rotatable about an upward-downward axis and a horizontal axis. The engine 1 is an example of a "second cooling target".

Figure 2:
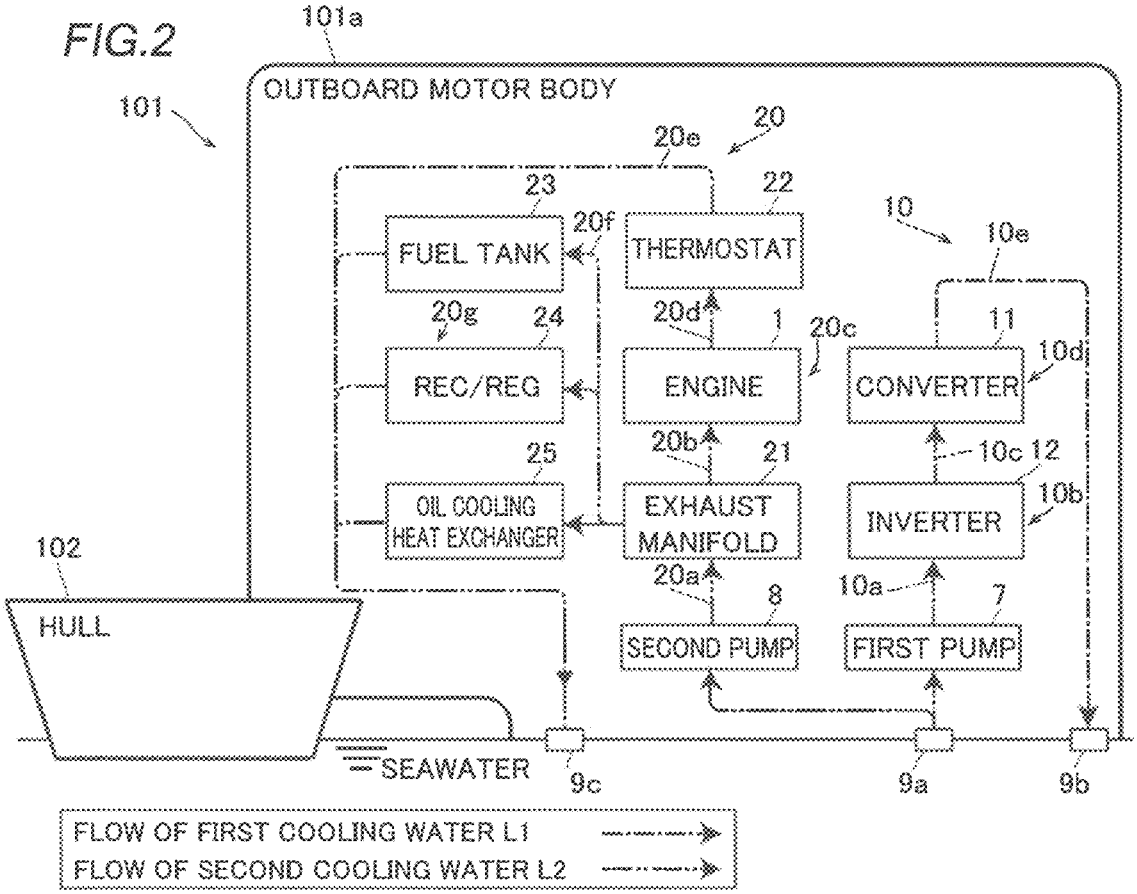
FIG. 2 is a diagram illustrating the configuration of first and second cooling water passages according to the first preferred embodiment of the present invention.
Figure 3:
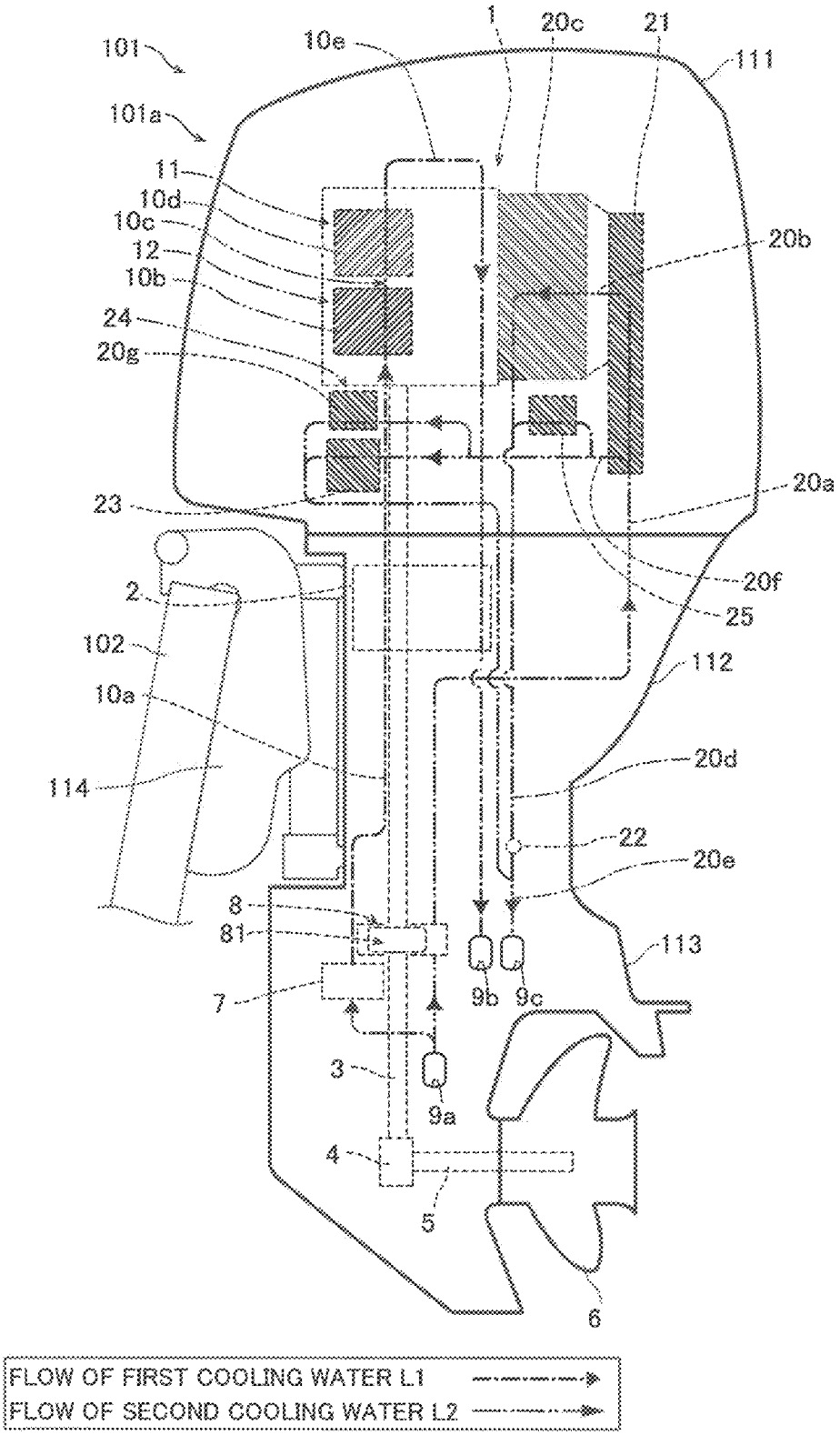
FIG. 3 is a side view showing the structure of the outboard motor according to the first preferred embodiment of the present invention.

As shown in FIGS. 2 and 3, the outboard motor 101 includes the engine 1, a propulsion motor 2, a drive shaft 3, a gearing 4, a propeller shaft 5, a propeller 6, a first pump 7, and a second pump 8. That is, the outboard motor 101 is a hybrid outboard motor driven by the engine 1 and driven by the propulsion motor 2. The propulsion motor 2 is an example of a "rotary electric machine that drives the outboard motor".

The engine 1 is an internal combustion engine driven by combustion of gasoline, light oil, or the like. The propulsion motor 2 is an electric motor driven by electric power supplied from an inverter 12 described below. The propulsion motor 2 is disposed adjacent to or in the vicinity of the drive shaft 3 in the upper case 112, for example. The propulsion motor 2 may be provided in a portion other than the upper case 112 in the outboard motor 101. For example, the propulsion motor 2 may be provided in the lower case 113.

The drive shaft 3 is coupled to a crankshaft (not shown) of the engine 1. The drive shaft 3 is coupled to a shaft (not shown) of the propulsion motor 2. Thus, the drive shaft 3 acquires each of a driving force from the engine 1 and a driving force from the propulsion motor 2. The drive shaft 3 extends in an upward-downward direction. An upper portion of the drive shaft 3 passes through the upper case 112, and a lower portion of the drive shaft 3 is disposed in the lower case 113.

The gearing 4 reduces rotation of the drive shaft 3 and transmits the rotation to the propeller shaft 5. That is, the gearing 4 transmits, to the propeller shaft 5 that rotates about a rotation axis extending in a forward-rearward direction, the driving force of the drive shaft 3 that rotates about a rotation axis extending in the upward-downward direction. Specifically, the gearing 4 switches the rotation direction (a forward movement direction and a reverse movement direction) of the propeller shaft 5. The gearing 4 is disposed in the lower case 113.

The propeller 6 (screw) is connected to the propeller shaft 5. The propeller 6 is driven to rotate about a rotation axis that extends in the forward-rearward direction. The propeller 6 generates a thrust in an axial direction by rotating in water. The propeller 6 moves the hull 102 forward or rearward according to the rotation direction.

As shown in FIG. 3, the first pump 7 pumps first cooling water L1 used to cool a converter 11 and the inverter 12 described below from the outside of the outboard motor body 101*a*. The first pump 7 pumps the first cooling water L1 into a first cooling water passage 10. Specifically, the first pump 7 takes in the first cooling water L1 via a water inlet 9*a*. The water inlet 9*a* is provided in the lower case 113, for example. After flowing through the first cooling water passage 10, the first cooling water L1 is discharged to the outside via a water outlet 9*b* of the outboard motor body 101*a*.

Figure 4:
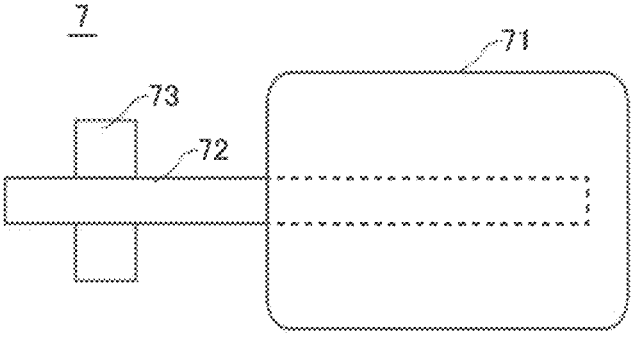
FIG. 4 is a side view schematically showing the structure of a first pump according to the first preferred embodiment of the present invention.

Specifically, as shown in FIG. 4, the first pump 7 is an electric pump, and is driven when electric power is supplied thereto. In other words, according to the first preferred embodiment, the first pump 7 is driven when electric power is supplied thereto even while the engine 1 is stopped. The first pump 7 includes a pump motor 71, a shaft 72, and an impeller 73.

The pump motor 71 rotates the shaft 72 using electric power from a pump power supply 14 (see FIG. 6) described below. Furthermore, the shaft 72 is fixed to the impeller 73, and transmits a driving force from the pump motor 71 to the impeller 73. Thus, the impeller 73 rotates.

Figure 5:
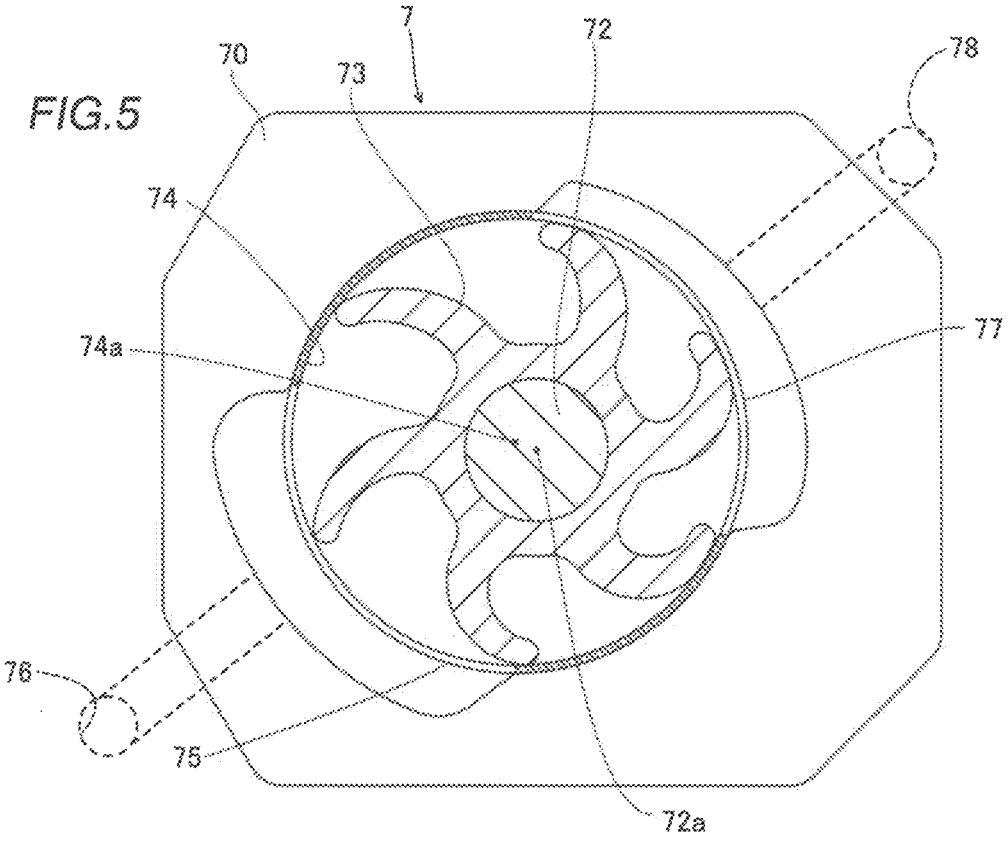
FIG. 5 is a sectional view schematically showing the structure of a first pump according to the first preferred embodiment of the present invention.

As shown in FIG. 5, the first pump 7 is a positive-displacement pump that pumps the first cooling water L1 due to a change in volume. Thus, the first pump 7 pumps water from the water inlet 9*a* provided upstream (downward) of the first pump 7 and flows the water into the first cooling water passage 10. Specifically, the first pump 7 includes a housing 70, a pump case 74, a suction port 75, a suction passage 76, a discharge port 77, and a discharge passage 78.

The impeller 73 includes a plurality of vanes disposed at predetermined rotation angle intervals. The impeller 73 is made of rubber, for example, and is elastically deformable. The impeller 73 is housed with the deformed vanes in the pump case 74. Ends of the vanes of the impeller 73 contact an inner wall of the pump case 74. The impeller 73 rotates in an eccentric state. That is, the center 74*a* of the pump case 74 and the center 72*a* of the shaft 72 are shifted from each other in a plan view (as viewed in the axial direction).

The pump case 74 is cylindrical. The suction port 75 and the discharge port 77 are provided on the outer periphery of the pump case 74. Specifically, the suction port 75 is disposed on the outer periphery of the pump case 74 at a position at which the volume of a space partitioned by the pump case 74 and the vanes of the impeller 73 is increased. The suction passage 76 is connected to the suction port 75 and the water inlet 9*a*. The discharge port 77 is disposed on the outer periphery of the pump case 74 at a position at which the volume of a space partitioned by the pump case 74 and the vanes of the impeller 73 is reduced. The discharge passage 78 is connected to the discharge port 77. The discharge passage 78 is connected to the first cooling water passage 10.

According to the first preferred embodiment, the cooling water pumping capacity per unit time of the first pump 7 is smaller than the cooling water pumping capacity per unit time of the second pump 8. For example, the flow rate (discharge rate) of the first pump 7 is 10 liters/minute or less, and preferably 3 liters/minute or more and 5 liters/minute or less. Thus, the cooling water pumping capacity per unit time of the first pump 7 is set to 3 liters/minute or more such that a cooling target is cooled even when the cooling target includes the converter 11 and the inverter 12, for example. In addition, the cooling water pumping capacity per unit time of the first pump 7 is set to 5 liters/minute or less such that an increase in the size of the first pump 7 is further significantly reduced or prevented.

As shown in FIG. 2, the second pump 8 pumps second cooling water L2 used to cool the engine 1, etc. from the outside of the outboard motor body 101*a*, and flow the second cooling water L2 into a second cooling water passage 20. Specifically, the second pump 8 takes in the second cooling water L2 via the water inlet 9*a*. That is, according to the first preferred embodiment, the first pump 7 and the second pump 8 pump water from the common water inlet 9*a*.

Specifically, as shown in FIG. 3, the second pump 8 is an engine-driven pump. That is, the second pump 8 is driven by the drive shaft 3 when the drive shaft 3 is driven by the engine 1. For example, an impeller 81 of the second pump 8 rotates integrally with the drive shaft 3. That is, the second pump 8 is driven when the engine 1 is driven, and is stopped when the engine 1 is stopped.

Similarly to the first pump 7 as a positive-displacement pump, the second pump 8 is a positive-displacement pump that pumps the second cooling water L2 due to a change in volume.

As shown in FIG. 2, the outboard motor 101 includes the first cooling water passage 10, the converter 11, and the inverter 12. The converter 11 and the inverter 12 are examples of a "first cooling target", an "electrical component", or a "component of a power supply system".

The first cooling water passage 10 flows the first cooling water L1 discharged from the first pump 7. The first cooling water passage 10 includes a first portion 10*a*, an inverter water jacket 10*b*, a second portion 10*c*, a converter water jacket 10*d*, and a third portion 10*e*. The inverter water jacket 10*b* is an example of a "portion that cools the inverter". The converter water jacket 10*d* is an example of a "portion that cools the converter".

The first portion 10*a*, the inverter water jacket 10*b*, the second portion 10*c*, the converter water jacket 10*d*, and the third portion 10*e* are sequentially disposed in this order from the water inlet 9*a* toward the water outlet 9*b*. That is, the inverter water jacket 10*b* is disposed upstream of the converter water jacket 10*d*.

The first portion 10*a* connects the first pump 7 to the inverter 12 (inverter water jacket 10*b*). The inverter water jacket 10*b* is adjacent to or in the vicinity of the inverter 12, and absorbs heat from the inverter 12 by the first cooling water L1. The second portion 10*c* connects the inverter 12 (inverter water jacket 10*b*) to the converter 11 (converter water jacket 10*d*). The converter water jacket 10*d* is adjacent to or in the vicinity of the converter 11, and absorbs heat from the converter 11 by the first cooling water L1. The third portion 10*e* connects the converter 11 (converter water jacket 10*d*) to the water outlet 9*b*.

According to the first preferred embodiment, the converter 11 and the inverter 12 are components of a power supply system that supply electric power to the propulsion motor 2. The converter 11 converts DC power from a battery (not shown) provided in the hull 102 or the outboard motor body 101*a* into DC power having a predetermined voltage. That is, the converter 11 is a DC-DC converter. The inverter 12 converts the power supplied from the converter 11 into AC power, and supplies the converted power to the propulsion motor 2.

Figure 6:
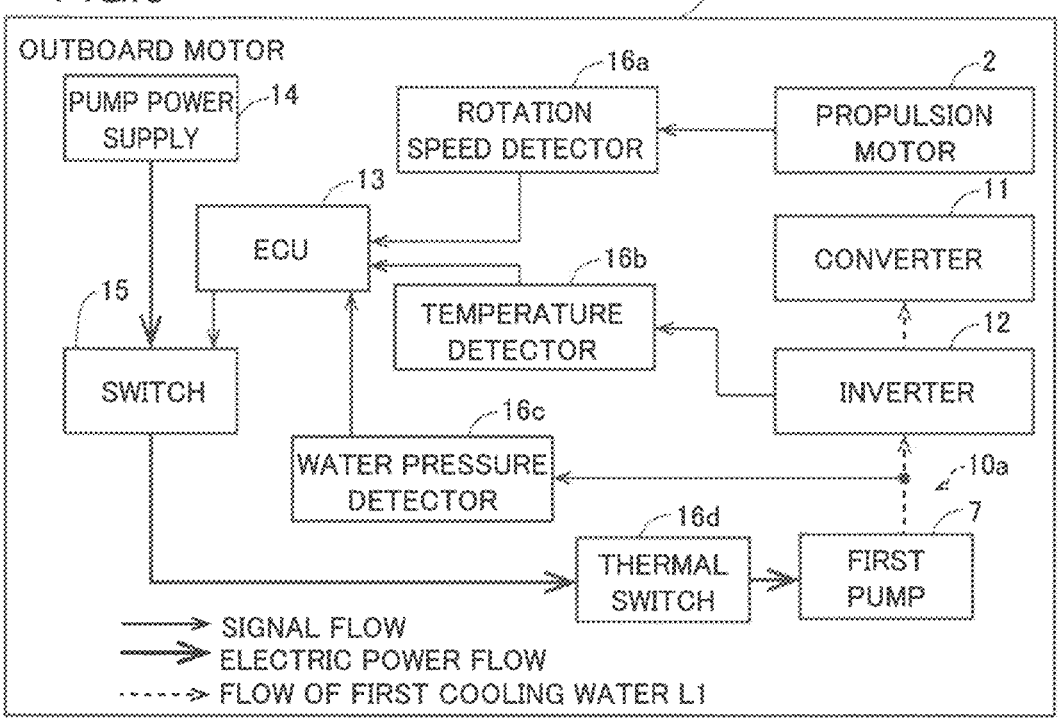
FIG. 6 is a block diagram showing the structure of the outboard motor according to the first preferred embodiment of the present invention.

As shown in FIG. 6, the outboard motor 101 includes an engine control unit (ECU) 13, the pump power supply 14, a switch 15, a rotation speed detector 16*a*, a temperature detector 16*b*, a water pressure detector 16*c*, and a thermal switch 16*d*.

The ECU 13 controls driving of the engine 1, driving of the propulsion motor 2, and driving of the first pump 7. For example, the ECU 13 controls the rotation speed of the engine 1, the rotation speed of the propulsion motor 2, and switching of the state (shift position) of the gearing 4 based on operation signals from the remote control 103 provided on the hull 102.

The switch 15 includes a relay circuit, for example. The switch 15 switches between a state in which a current from the pump power supply 14 is supplied to the first pump 7 and a state in which the current from the pump power supply 14 is not supplied to the first pump 7 based on a command from the ECU 13.

The rotation speed detector 16*a* is a sensor that detects the rotation speed of the propulsion motor 2 and transmits information about the detected rotation speed to the ECU 13. The temperature detector 16*b* is a sensor provided inside, adjacent to, or in the vicinity of the inverter 12 and that detects the temperature of the inverter 12. The temperature detector 16*b* transmits information about the detected temperature of the inverter 12 to the ECU 13. The water pressure detector 16*c* detects a water pressure in the first portion 10*a* of the first cooling water passage 10. The water pressure detector 16*c* transmits information about the detected water pressure in the first portion 10*a* to the ECU 13.

The thermal switch 16*d* is disposed in a current path between the pump power supply 14 and the first pump 7. The thermal switch 16*d* is disposed inside, adjacent to, or in the vicinity of the first pump 7, and when the temperature of the first pump 7 (thermal switch 16*d*) becomes equal to or higher than a predetermined temperature threshold (when the first pump 7 has an abnormal temperature) or when a current that flows through the first pump 7 becomes an overcurrent, the current path between the pump power supply 14 and the first pump 7 is disconnected.

According to the first preferred embodiment, the ECU 13 controls driving of the first pump 7 by switching the switch 15 based on the rotation speed of the propulsion motor 2 detected by the rotation speed detector 16*a*, the temperature of the inverter 12 detected by the temperature detector 16*b*, and the water pressure in the first cooling water passage 10 detected by the water pressure detector 16*c*.

For example, the ECU 13 performs a control to drive the first pump 7 when the rotation speed of the propulsion motor 2 is equal to or higher than a predetermined value (when the propulsion motor 2 is driven). The ECU 13 performs a control to stop driving the first pump 7 when the temperature of the inverter 12 detected by the temperature detector 16*b* is equal to or higher than the temperature threshold of the inverter 12. At this time, the ECU 13 performs a control to stop driving the propulsion motor 2 in addition to the control to stop driving the first pump 7. Furthermore, the ECU 13 performs a control to stop driving the first pump 7 when the water pressure detected by the water pressure detector 16*c* is equal to or lower than a water pressure threshold. At this time, the ECU 13 performs a control to stop driving the propulsion motor 2 in addition to the control to stop driving the first pump 7.

As shown in FIGS. 2 and 3, the outboard motor 101 includes the second cooling water passage 20, an exhaust manifold 21, a thermostat 22, the fuel tank 23, the REC/REG 24, and an oil cooling heat exchanger 25 (hereinafter referred to as a "heat exchanger 25"). The exhaust manifold 21, the fuel tank 23, the REC/REG 24, and the heat exchanger 25 are examples of a "second cooling target".

The second cooling water passage 20 flows the second cooling water L2 discharged from the second pump 8. The second cooling water passage 20 includes a first portion 20*a*, a second portion 20*b*, an engine cooling water jacket 20*c* (hereinafter referred to as a "water jacket 20*c*"), a third portion 20*d*, a fourth portion 20*e*, a fifth portion 20*f*, and a REC/REG cooling water jacket 20*g* (hereinafter referred to as a "water jacket 20*g*").

The first portion 20*a*, the exhaust manifold 21, the second portion 20*b*, the water jacket 20*c*, the third portion 20*d*, the thermostat 22, and the fourth portion 20*e* are sequentially disposed in this order from the water inlet 9*a* (upstream side) toward a water outlet 9*c* (downstream side).

The fifth portion 20*f* is branched into a portion that cools the fuel tank 23, a water jacket 20*g*, and the heat exchanger 25, the water jacket 20*g*, and the heat exchanger 25 downstream of a portion that cools the exhaust manifold 21. The portion that cools the fuel tank 23, the water jacket 20*g*, and the heat exchanger 25 are each connected to the fourth portion 20*e*.

When the rotation speed of the engine 1 decreases, the opening of the thermostat 22 gradually decreases as the temperature of the second cooling water L2 decreases, such that the flow rate of the second cooling water L2 that passes through the water jacket 20*c* gradually decreases. The fuel tank 23 is housed in the cowl 111, and stores volatile fuel. The REC/REG 24 converts electric power generated based on driving of the engine 1 into a direct current of a predetermined voltage and outputs the direct current to the battery (not shown). The heat exchanger 25 cools engine oil that flows through an engine oil passage (not shown) with the second cooling water L2.

The flow of the first cooling water L1 and the flow of the second cooling water L2 are now described with reference to FIGS. 2 and 3. The first cooling water L1 is taken in via the water inlet 9*a* provided in the lower case 113, and flows into the first pump 7. Then, the first cooling water L1 pressurized and discharged by the first pump 7 is sent to the inverter water jacket 10*b*. Then, the first cooling water L1 flows into the converter water jacket 10*d* downstream of the inverter water jacket 10*b*. Thereafter, the first cooling water L1 is discharged via the water outlet 9*b*. Consequently, the first cooling water L1 flows through the inverter water jacket 10*b* such that the inverter 12 is cooled, and the first cooling water L1 flows through the converter water jacket 10*d* such that the converter 11 is cooled.

The second cooling water L2 is taken in via the water inlet 9*a* provided in the lower case 113, and flows into the second pump 8. Then, the second cooling water L2 pressurized and discharged by the second pump 8 is sent to the exhaust manifold 21. Then, the second cooling water L2 flows through the water jacket 20*c* and the thermostat 22 in this order. Furthermore, the second cooling water L2 is sent to the fuel tank 23, the water jacket 20*g*, and the heat exchanger 25 from the portion that cools the exhaust manifold 21. Thereafter, the second cooling water L2 discharged from each of the thermostat 22, the fuel tank 23, the water jacket 20*g*, and the heat exchanger 25 is discharged via the water outlet 9*c*. Consequently, the engine 1, the engine oil, the exhaust manifold 21, and the fuel in the fuel tank 23 are cooled with the second cooling water L2.

According to the first preferred embodiment of the present invention, the following advantageous effects are achieved.

According to the first preferred embodiment of the present invention, the first pump 7 is an electric pump that pumps the first cooling water L1 from the outside of the outboard motor body 101*a* and flows the first cooling water L1 into the first cooling water passage 10. Accordingly, even while the engine 1 is stopped, the first pump 7 defines and functions as an electric pump driven by electric power to pump the first cooling water L1 from the outside. Therefore, even while the engine 1 is stopped, the first pump 7 is driven such that the converter 11 and the inverter 12 are cooled with the first cooling water L1.

According to the first preferred embodiment of the present invention, the engine 1 rotates the drive shaft 3 connected to the propeller 6. Furthermore, the outboard motor 101 includes the propulsion motor 2 that rotates the drive shaft 3. In addition, the converter 11 and the inverter 12 are components of a power supply system that supplies electric power to the propulsion motor 2. Accordingly, even while the engine 1 is stopped, the first pump 7 is driven such that the converter 11 and the inverter 12 as components of a power supply system that supplies electric power to the propulsion motor 2 are cooled with the first cooling water L1. Consequently, even when the hybrid technology of the engine 1 and the propulsion motor 2 is applied to the outboard motor 101, electrical components (the converter 11 and the inverter 12), for example, are effectively cooled.

According to the first preferred embodiment of the present invention, the outboard motor 101 further includes the second cooling water passage 20 including the engine 1, etc., through which the second cooling water L2 passes, and the second pump 8 that pumps the second cooling water L2 into the second cooling water passage 20. Accordingly, the outboard motor 101 includes the first pump 7 and the second pump 8, and thus unlike a case in which all of the cooling targets are cooled by one pump, the cooling target (first cooling target) cooled by the first pump 7 and the cooling target (second cooling target) cooled by the second pump 8 are separated. Therefore, an increase in the size of each of the first pump 7 and the second pump 8 is significantly reduced or prevented. Consequently, the first pump 7 and the second pump 8, in which increases in their sizes are significantly reduced or prevented, are separated and easily disposed in a limited space inside the outboard motor 101.

According to the first preferred embodiment of the present invention, the first pump 7 has a first cooling water L1 pumping capacity per unit time smaller than the second cooling water L2 pumping capacity per unit time of the second pump 8. Accordingly, an increase in the size of the first pump 7 is further significantly reduced or prevented.

According to the first preferred embodiment of the present invention, both the first pump 7 and the second pump 8 are positive-displacement pumps. Accordingly, both the first pump 7 and the second pump 8 easily pump water from outside the outboard motor body 101*a* without priming the first pump 7 and the second pump 8.

According to the first preferred embodiment of the present invention, the first cooling water passage 10 and the second cooling water passage 20 include the common water inlet 9*a* through which the first cooling water L1 and the second cooling water L2 are taken in upstream of the inverter 12 and upstream of the engine 1. Accordingly, the water inlet 9*a* through which the first cooling water L1 is taken in and the water inlet 9*a* through which the second cooling water L2 is taken in are shared, and thus a complex structure of the outboard motor 101 is significantly reduced or prevented.

According to the first preferred embodiment of the present invention, the second pump 8 is an engine-driven pump driven by the drive shaft 3 when the engine 1 drives the drive shaft 3. Accordingly, the flow rate of the second cooling water L2 that flows through the second cooling water passage 20 is increased according to an increase in the amount of heat generated by the engine 1.

According to the first preferred embodiment of the present invention, the outboard motor 101 includes the rotation speed detector 16*a* that detects the rotation speed of the propulsion motor 2. Furthermore, driving of the first pump 7 is controlled based on the rotation speed of the propulsion motor 2 detected by the rotation speed detector 16*a*. Accordingly, the rotation speed of the propulsion motor 2 is detected such that the first pump 7 is driven as necessary. For example, when the propulsion motor 2 is being driven and the converter 11 and the inverter 12 are generating heat, the first pump 7 is effectively driven.

According to the first preferred embodiment of the present invention, the first pump 7 is drivable while the engine 1 is stopped. Accordingly, the first pump 7 is driven while the engine 1 is stopped, and thus the converter 11 and the inverter 12 are cooled even while the engine 1 is stopped.

According to the first preferred embodiment of the present invention, the first cooling water passage 10 includes the inverter water jacket 10*b*, which is a portion that cools the inverter 12, upstream of the converter water jacket 10*d*, which is a portion that cools the converter 11. Accordingly, the inverter 12 that generates more heat than the converter 11 is cooled in a relatively upstream portion of the first cooling water passage 10. Consequently, the first cooling water L1 on the upstream side on which the temperature is lower than that on the downstream side effectively cools the inverter 12 that generates a large amount of heat.

According to the first preferred embodiment of the present invention, the outboard motor 101 includes the temperature detector 16*b* that detects the temperature of the inverter 12. Furthermore, driving of the first pump 7 is controlled based on the temperature detected by the temperature detector 16*b*. Accordingly, for example, when the temperature of the inverter 12 is abnormal, driving of the first pump 7 is limited. Consequently, driving of the first pump 7 in an abnormal state is significantly reduced or prevented.

According to the first preferred embodiment of the present invention, the outboard motor 101 includes the water pressure detector 16*c* that detects the water pressure of the first cooling water L1 that flows through the first cooling water passage 10. Furthermore, driving of the first pump 7 is stopped when the water pressure detected by the water pressure detector 16*c* is equal to or lower than the water pressure threshold. Accordingly, when there is a possibility that the first pump 7 is not operating normally, driving of the first pump 7 is stopped. Consequently, driving of the first pump 7 in an abnormal state is significantly reduced or prevented.

Second Preferred Embodiment

The structure of an outboard motor 201 of a marine vessel 200 according to a second preferred embodiment of the present invention is now described with reference to FIG. 7. In the second preferred embodiment, a propulsion motor 202 is cooled with first cooling water L1. In the second preferred embodiment, the same or similar structures as those of the first preferred embodiment are denoted by the same reference numerals, and description thereof is omitted. The propulsion motor 202 is an example of a "first cooling target".

Figure 7:
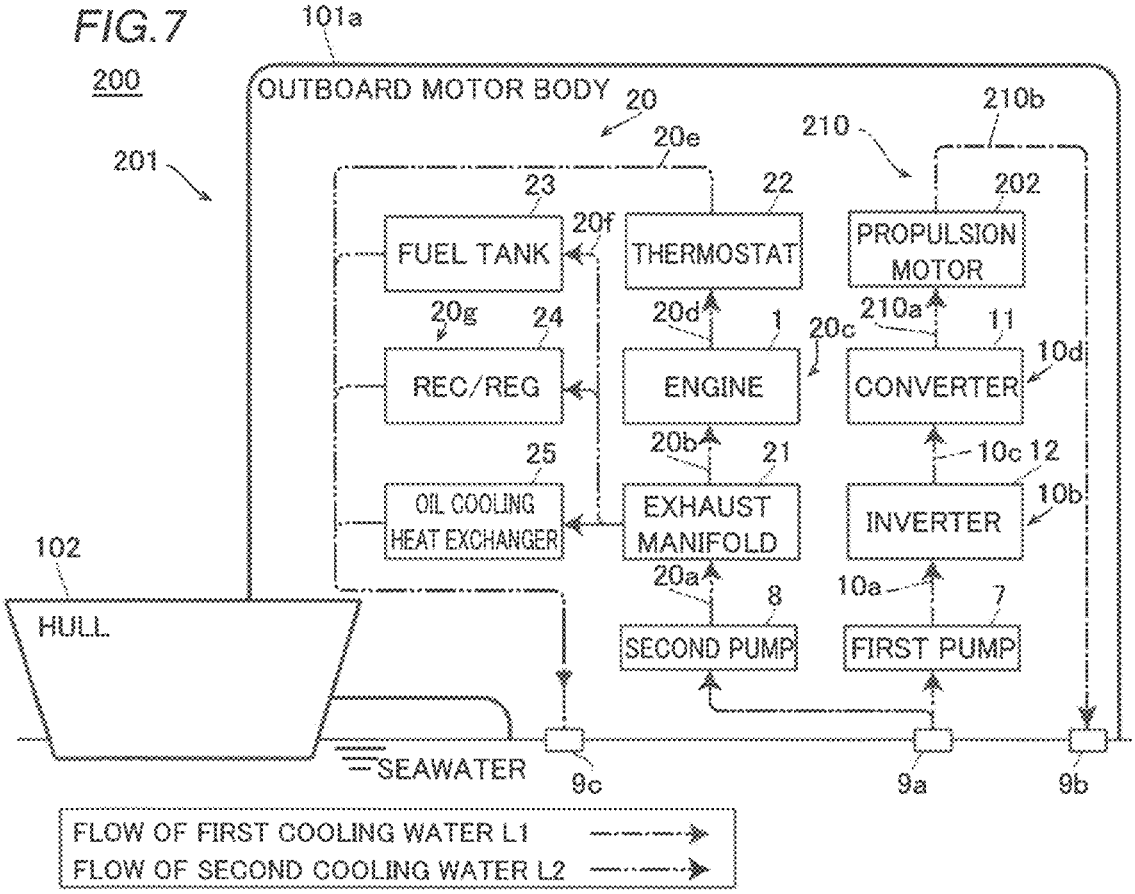
FIG. 7 is a diagram illustrating the configuration of first and second cooling water passages according to a second preferred embodiment of the present invention.

As shown in FIG. 7, the outboard motor 201 of the marine vessel 200 according to the second preferred embodiment includes a first cooling water passage 210. In the outboard motor 201 according to the second preferred embodiment, the propulsion motor 202 is disposed in the first cooling water passage 210, and the propulsion motor 202 is cooled with the first cooling water L1. Specifically, the first cooling water passage 210 includes a first portion 210*a* that connects a converter 11 to a portion that cools the propulsion motor 202, and a second portion 210*b* that connects the portion that cools the propulsion motor 202 to a water outlet 9*b*. Thus, the first cooling water L1 is pumped from the outside of the outboard motor 201 by a first pump 7, cools an inverter 12, cools the converter 11, cools the propulsion motor 202, and is discharged to the outside of the outboard motor 201. The remaining structures of the second preferred embodiment are similar to those of the first preferred embodiment.

According to the second preferred embodiment of the present invention, the following advantageous effects are achieved.

According to the second preferred embodiment of the present invention, in the outboard motor 201, the propulsion motor 202 that rotates a drive shaft 3 is cooled with the first cooling water L1. Accordingly, even while an engine 1 is stopped, the propulsion motor 202 that generates heat when driven is cooled with the first cooling water L1 using the first pump 7. The remaining advantageous effects of the second preferred embodiment are similar to those of the first preferred embodiment.

Third Preferred Embodiment

The structure of an outboard motor 301 of a marine vessel 300 according to a third preferred embodiment of the present invention is now described with reference to FIG. 8. In the third preferred embodiment, a fuel tank 323 and a REC/REG 324 are cooled with first cooling water L1. In the third preferred embodiment, the same or similar structures as those of the first preferred embodiment are denoted by the same reference numerals, and description thereof is omitted. The fuel tank 323 and the REC/REG 324 are examples of a "first cooling target".

Figure 8:
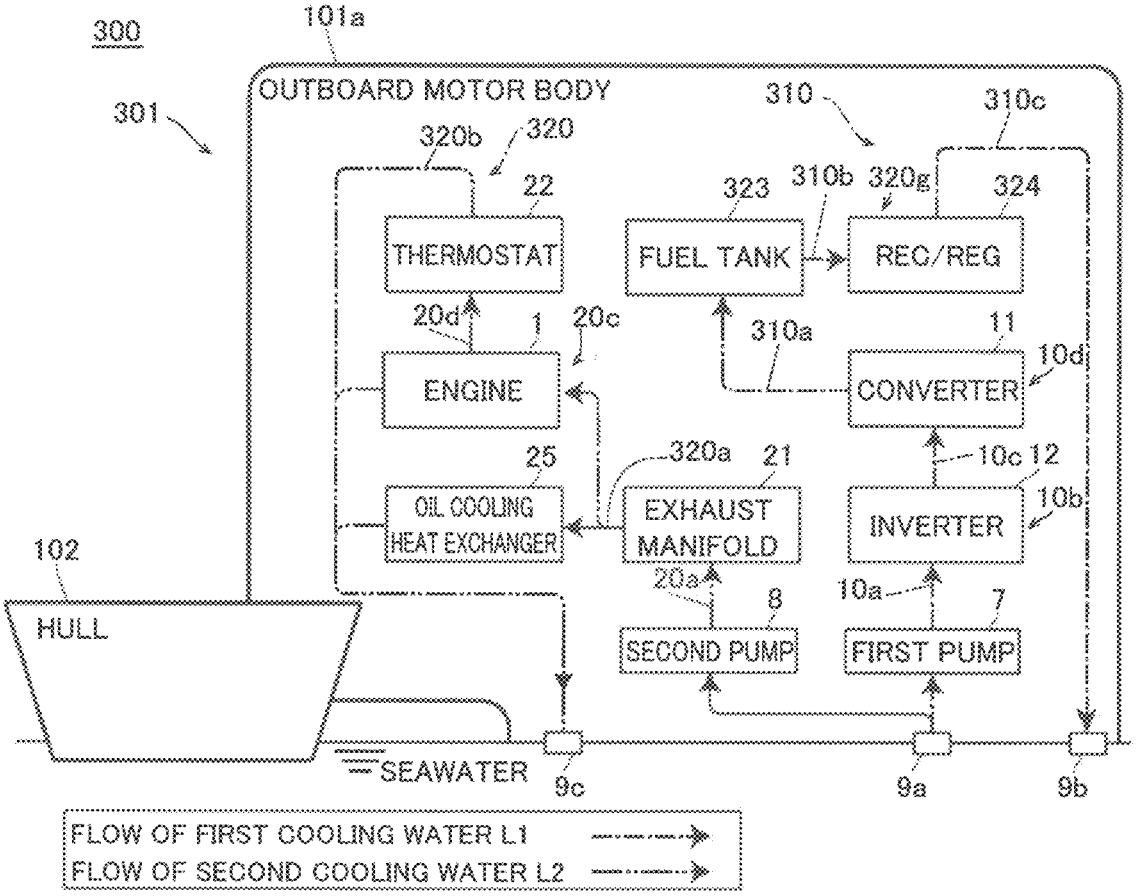
FIG. 8 is a diagram illustrating the configuration of first and second cooling water passages according to a third preferred embodiment of the present invention.

As shown in FIG. 8, the outboard motor 301 of the marine vessel 300 according to the third preferred embodiment includes a first cooling water passage 310 and a second cooling water passage 320. The first cooling water passage 310 is disposed along the fuel tank 323 and the REC/REG 324. That is, in the outboard motor 301, a water jacket 320*g* that cools the fuel tank 323 and the REC/REG 324 is disposed in the first cooling water passage 310, and fuel in the fuel tank 323 and the REC/REG 324 are cooled with the first cooling water L1.

Specifically, the first cooling water passage 310 includes a first portion 310*a* that connects a converter 11 to a portion that cools the fuel tank 323, a second portion 310*b* that connects the fuel tank 323 to the water jacket 320*g*, and a third portion 310*c* that connects the water jacket 320*g* to a water outlet 9*b*. Thus, the first cooling water L1 is pumped from the outside of the outboard motor 301 by a first pump 7, cools an inverter 12, cools the converter 11, cools the fuel in the fuel tank 323, and cools the REC/REG 324, and is discharged to the outside of the outboard motor 301. The remaining structures of the third preferred embodiment are similar to those of the first preferred embodiment.

According to the third preferred embodiment of the present invention, the following advantageous effects are achieved.

According to the third preferred embodiment of the present invention, the first cooling water passage 310 is disposed along the fuel tank 323 such that the first cooling water L1 in the first cooling water passage 310 cools fuel in the fuel tank 323. Accordingly, the temperature becomes high immediately after an engine 1 is stopped, and thus the fuel in the fuel tank 323, which is preferably cooled even while the engine 1 is stopped, is cooled with the first cooling water L1. Consequently, even while the engine 1 is stopped, the fuel in the fuel tank 323 is cooled such that volatilization of the fuel is significantly reduced or prevented.

According to the third preferred embodiment of the present invention, the first cooling water passage 310 is disposed along the REC/REG 324 such that the first cooling water L1 in the first cooling water passage 310 cools the REC/REG 324. Accordingly, the REC/REG 324 is cooled even while the engine 1 is stopped. Consequently, even when the temperature of the REC/REG 324 is relatively high after the engine 1 is stopped, the REC/REG 324 is effectively cooled with the first cooling water L1. The remaining advantageous effects of the third preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while examples of the first cooling target preferably include a converter, an inverter, a propulsion motor, a fuel tank, and a REC/REG in each of the first to third preferred embodiments described above, the present invention is not restricted to this. For example, the first cooling target may alternatively include other components (such as an ECU and a battery).

While both the converter and the inverter are preferably cooled as the first cooling targets in each of the first to third preferred embodiments described above, the present invention is not restricted to this. For example, only one of the converter and the inverter may alternatively be cooled as the first cooling target.

While the second pump is preferably an engine-driven pump in each of the first to third preferred embodiments described above, the present invention is not restricted to this. For example, the second pump may alternatively be an electric pump.

While the cooling water pumping capacity per unit time of the first pump is preferably smaller than the cooling water pumping capacity per unit time of the second pump in each of the first to third preferred embodiments described above, the present invention is not restricted to this. For example, the cooling water pumping capacity per unit time of the first pump may alternatively be equal to or larger than the cooling water pumping capacity per unit time of the second pump.

While the outboard motor preferably includes the common water inlet through which the first cooling water and the second cooling water are taken in in each of the first to third preferred embodiments described above, the present invention is not restricted to this. For example, a water inlet through which the first cooling water is taken in and a water inlet through which the second cooling water is taken in may alternatively be separately provided. Alternatively, the common water inlet, the water inlet through which the first cooling water is taken in, or the water inlet through which the second cooling water is taken in may not be provided in the outboard motor but may be provided in the hull.

While the inverter water jacket is preferably provided upstream of the converter water jacket in each of the first to third preferred embodiments described above, the present invention is not restricted to this. For example, the inverter water jacket may alternatively be provided downstream of the converter water jacket.

While both the first pump and the second pump are preferably positive-displacement pumps in each of the first to third preferred embodiments described above, the present invention is not restricted to this. For example, at least one of the first pump and the second pump may alternatively be a non-positive displacement pump as long as the cooling water is pumped.

While the water outlets for the first cooling water and the second cooling water are preferably provided in the lower case as shown in FIG. 3 in each of the first to third preferred embodiments described above, the present invention is not restricted to this. For example, the water outlets may alternatively be provided in the propeller.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a first cooling water passage through which first cooling water including water from outside an outboard motor body passes to cool at least one of an electrical component or fuel in a fuel tank; and a first pump that is an electric pump to pump the first cooling water from outside of the outboard motor body into the first cooling water passage;

a second cooling water passage through which second cooling water passes to cool at least the engine;

a second pump to pump the second cooling water into the second cooling water passage; wherein the first cooling water passage and the second cooling water passage are independent of each other and configured to discharge cooling water from different outlets.

2. The outboard motor according to claim 1, wherein the engine rotates a drive shaft connected to a propeller;

the outboard motor further comprises a rotary electric machine that drives the outboard motor by rotating the drive shaft; and the electrical component includes a component of a power supply system that supplies electric power to the rotary electric machine.

3. The outboard motor according to claim 1, wherein the first pump has a cooling water pumping capacity per unit time smaller than a cooling water pumping capacity per unit time of the second pump.

4. The outboard motor according to claim 1, wherein both the first pump and the second pump are positive-displacement pumps.

5. The outboard motor according to claim 1, wherein the first cooling water passage and the second cooling water passage include a common water inlet through which the first cooling water and the second cooling water are taken in upstream of at least one of the electrical component or the fuel in the fuel tank and upstream of the engine.

6. The outboard motor according to claim 1, wherein the second pump is driven by a drive shaft when the engine drives the drive shaft.

7. The outboard motor according to claim 1, wherein the engine rotates a drive shaft connected to a propeller; and the first cooling water passage is configured to cool a rotary electric machine that drives the outboard motor by rotating the drive shaft.

8. The outboard motor according to claim 2, further comprising:

a rotation speed detector to detect a rotation speed of the rotary electric machine; wherein driving of the first pump is controlled based on the rotation speed of the rotary electric machine detected by the rotation speed detector.

9. The outboard motor according to claim 1, wherein the first pump is drivable while the engine is stopped.

10. The outboard motor according to claim 1, wherein the electrical component includes a component of a power supply system including an inverter and a converter; and the first cooling water passage includes a portion that cools the inverter upstream of a portion that cools the converter.

11. The outboard motor according to claim 1, further comprising:

a temperature detector to detect a temperature of the electrical component; wherein driving of the first pump is controlled based on the temperature detected by the temperature detector.

12. The outboard motor according to claim 1, further comprising:

a water pressure detector to detect a water pressure of the first cooling water that flows through the first cooling water passage; wherein driving of the first pump is stopped when the water pressure detected by the water pressure detector is equal to or lower than a water pressure threshold.

13. The outboard motor according to claim 1, wherein the first cooling water passage is disposed along the fuel tank such that the first cooling water in the first cooling water passage cools the fuel in the fuel tank.

14. The outboard motor according to claim 1, wherein the electrical component includes a rectifier/regulator; and the first cooling water passage is disposed along the rectifier/regulator such that the first cooling water in the first cooling water passage cools the rectifier/regulator.

15. A marine vessel comprising:

a hull; and an outboard motor attached to the hull and including an engine; wherein the outboard motor includes:

a first cooling water passage through which first cooling water including water from outside an outboard motor body passes to cool at least one of an electrical component or fuel in a fuel tank;

a first pump that is an electric pump to pump the first cooling water from outside of the outboard motor body into the first cooling water passage;

a second cooling water passage through which second cooling water passes to cool at least the engine;

a second pump to pump the second cooling water into the second cooling water passage; wherein the first cooling water passage and the second cooling water passage are independent of each other and configured to discharge water from different outlets.

16. The marine vessel according to claim 15, wherein the engine rotates a drive shaft connected to a propeller;

the marine vessel further comprises a rotary electric machine to drive the outboard motor by rotating the drive shaft; and the electrical component includes a component of a power supply system that supplies electric power to the rotary electric machine.

17. The marine vessel according to claim 15, wherein the first pump has a cooling water pumping capacity per unit time smaller than a cooling water pumping capacity per unit time of the second pump.

18. The marine vessel according to claim 15, wherein both the first pump and the second pump are positive-displacement pumps.

19. An outboard motor comprising:

an engine;

a first cooling water passage through which first cooling water including water from outside an outboard motor body passes to cool at least one of an electrical component or fuel in a fuel tank; and a first pump that is an electric pump to pump the first cooling water from outside of the outboard motor body into the first cooling water passage; wherein the electrical component includes a rectifier/regulator; and the first cooling water passage is disposed along the rectifier/regulator such that the first cooling water in the first cooling water passage cools the rectifier/regulator.

* * * * *